US011713572B2

(12) United States Patent
Zemler et al.

(10) Patent No.: US 11,713,572 B2
(45) Date of Patent: Aug. 1, 2023

(54) PROCESS FOR ASSEMBLING A UNITIZED PANEL FOR USE WITHIN AN EXTERIOR DYNAMIC CURTAIN WALL ASSEMBLY

(71) Applicant: Hilti Aktiengesellschaft, Schaan (LI)

(72) Inventors: Matthew Zemler, Corinth, TX (US); Arndt Andresen, North Richland Hills, TX (US); Chad Stroike, Roanoke, TX (US)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 17/223,763

(22) Filed: Apr. 6, 2021

(65) Prior Publication Data

US 2021/0222423 A1 Jul. 22, 2021

Related U.S. Application Data

(63) Continuation-in-part of application No. 15/929,347, filed on Apr. 28, 2020, now Pat. No. 11,002,007,
(Continued)

(51) Int. Cl.
*E04B 1/76* (2006.01)
*E04B 1/94* (2006.01)
(Continued)

(52) U.S. Cl.
CPC ..... *E04B 1/7675* (2013.01); *E04B 1/7616* (2013.01); *E04B 1/7625* (2013.01);
(Continued)

(58) Field of Classification Search
USPC ..... 52/404.1, 406.2, 406.1, 406.3, 407.2
See application file for complete search history.

(56) References Cited

U.S. PATENT DOCUMENTS 1,821,011 A * 9/1931 Greenlaw ..... B65D 27/38 229/311
1,963,923 A * 6/1934 Sinel ..... B65D 75/66 229/89
(Continued)

FOREIGN PATENT DOCUMENTS

CA 2 787 642 3/2013
CA 20841 523 9/2014
(Continued)

OTHER PUBLICATIONS

Internationai Search Report dated Aug. 23, 2018 in PCT/EP2018/063081.
(Continued)

*Primary Examiner* — Joshua K Ihezie
(74) *Attorney, Agent, or Firm* — Grüneberg and Myers, PLLC

(57) ABSTRACT

A box assembly includes a box, a door, an opener, and an insulation material. The box is configured to be installed on a curtain wall. The door encloses an interior space of the box. The opener is configured to open the door. The insulation material is in a compressed state in the interior space when the door is closed. The insulation material is configured to transition to an uncompressed state when the opener opens the door. When the door is opened, the insulation material at least partially extends from the interior space into a safing slot adjacent the curtain wall when the box is in an installed state and the door is opened.

20 Claims, 8 Drawing Sheets

Related U.S. Application Data which is a continuation of application No. 16/610,420, filed as application No. PCT/EP2018/063081 on May 18, 2018, now Pat. No. 10,669,709, which is a continuation of application No. 15/600,295, filed on May 19, 2017, now Pat. No. 10,202,759.

(51) Int. Cl.
*E04B 2/90* (2006.01)
*E04B 1/68* (2006.01)
*E04B 1/84* (2006.01)

(52) U.S. Cl.
CPC ..... *E04B 1/948* (2013.01); *E04B 2/90* (2013.01); *E04B 1/6815* (2013.01); *E04B 1/7612* (2013.01); *E04B 1/94* (2013.01); *E04B 2001/8438* (2013.01)

(56) References Cited

U.S. PATENT DOCUMENTS 2,080,080 A * 5/1937 Lawrence ..... B65D 75/70 206/264
3,753,843 A * 8/1973 Hutchison ..... E04C 2/365 428/116
3,786,604 A * 1/1974 Kramer ..... E04B 1/6801 52/232
4,204,373 A * 5/1980 Davidson ..... E06B 1/64 52/127.7
4,344,265 A * 8/1982 Davidson ..... E04F 21/0015 52/404.3
4,449,341 A * 5/1984 Taglianetti ..... E04B 2/88 52/235
4,662,136 A * 5/1987 Tanikawa ..... E04B 2/90 52/235
4,669,240 A * 6/1987 Amormino ..... E04B 1/04 264/253
4,781,003 A * 11/1988 Rizza ..... E04B 1/6804 404/69
4,866,898 A * 9/1989 LaRoche ..... E04B 1/6804 52/396.01
4,873,805 A * 10/1989 Ting ..... E04B 2/96 52/235
5,318,997 A 6/1994 Okada et al.
5,502,937 A * 4/1996 Wilson ..... B32B 15/14 52/273
5,519,068 A 5/1996 Okada et al.
5,765,332 A * 6/1998 Landin ..... E04B 1/948 52/235
5,889,067 A 3/1999 Jang et al.
5,960,594 A * 10/1999 Cronin ..... E06B 3/5063 52/99
5,987,833 A * 11/1999 Heffelfinger ..... E04B 1/78 52/407.3
6,360,502 B1 3/2002 Stahl, Jr.
D502,147 S 2/2005 Stahl, Sr.
7,152,385 B2 * 12/2006 Morgan ..... E04B 2/7411 52/745.05
7,240,905 B1 7/2007 Stahl, Sr.
7,373,761 B2 5/2008 Stahl, Sr.
7,424,793 B1 * 9/2008 Shriver ..... E04B 2/88 52/235
7,427,050 B2 9/2008 Stahl, Sr. et al.
7,523,590 B2 4/2009 Stahl, Sr.
7,596,914 B2 10/2009 Stahl, Sr. et al.
7,644,549 B2 * 1/2010 Speck ..... E04B 2/90 52/235
7,685,792 B2 3/2010 Stahl, Sr. et al.
7,694,474 B1 4/2010 Stahl, Sr. et al.
7,797,893 B2 9/2010 Stahl, Sr. et al.
7,827,746 B2 11/2010 Speck
7,856,775 B2 * 12/2010 Stahl, Jr. ..... E04B 2/88 52/232
7,886,904 B1 * 2/2011 Evans ..... B65D 85/07 206/83.5
7,971,813 B2 * 7/2011 O'Leary ..... B02C 18/2216 241/60
D657,232 S 4/2012 Stahl, Sr. et al.
8,318,304 B2 * 11/2012 Valenziano ..... B32B 1/08 428/372
8,375,666 B2 2/2013 Stahl, Jr. et al.
8,397,452 B2 3/2013 Stahl, Sr. et al.
8,578,672 B2 * 11/2013 Mattox ..... E04B 1/948 52/396.01
8,584,415 B2 11/2013 Stahl, Jr. et al.
8,601,760 B2 * 12/2013 Hilburn, Jr. ..... E04B 1/947 52/232
8,671,645 B1 * 3/2014 Shriver ..... E04B 2/88 52/741.4
8,683,763 B2 * 4/2014 Shriver ..... E04B 1/947 52/235
8,793,946 B2 8/2014 Stahl, Jr. et al.
8,869,475 B2 10/2014 Lopes
8,887,458 B2 11/2014 Lopes
8,955,275 B2 2/2015 Stahl, Jr.
9,016,013 B2 4/2015 Stahl, Jr. et al.
9,016,014 B2 * 4/2015 Shriver ..... E04B 2/96 52/235
9,476,202 B2 * 10/2016 Clancy ..... E04B 1/80
10,202,759 B2 2/2019 Andresen et al.
10,323,409 B1 * 6/2019 Robinson ..... E01C 11/106
10,352,040 B1 * 7/2019 Preston ..... E04B 1/6807
10,597,867 B2 * 3/2020 Hulteen ..... B32B 15/08
10,669,709 B2 * 6/2020 Zemler ..... E04B 1/7675
10,731,338 B1 * 8/2020 Zemler ..... E04B 1/948
10,914,065 B2 * 2/2021 Pilz ..... E04B 2/7411
10,920,417 B2 * 2/2021 Hulteen ..... E04B 1/948
10,982,435 B2 * 4/2021 Foerg ..... C09J 7/26
2006/0138251 A1 6/2006 Stahl, Sr.
2007/0125018 A1 6/2007 Stahl, Sr.
2007/0151183 A1 7/2007 Stahl, Sr. et al.
2007/0175125 A1 8/2007 Stahl, Sr. et al.
2007/0204540 A1 * 9/2007 Stahl ..... E04B 5/00 52/274
2007/0261339 A1 11/2007 Stahl, Sr. et al.
2007/0261343 A1 11/2007 Stahl, Sr. et al.
2009/0126297 A1 * 5/2009 Stahl, Jr. ..... E04B 2/88 52/235
2010/0107532 A1 * 5/2010 Shriver ..... E04B 2/96 52/317
2011/0011019 A1 1/2011 Stahl, Jr. et al.
2011/0088342 A1 4/2011 Stahl, Sr. et al.
2011/0094759 A1 4/2011 Lopes
2011/0209426 A1 * 9/2011 Pollack ..... F24F 5/0075 52/302.1
2013/0061544 A1 * 3/2013 Stahl, Jr ..... A62C 2/10 52/232
2013/0091790 A1 4/2013 Stahl, Jr. et al.
2013/0097948 A1 * 4/2013 Burgess ..... E04B 2/00 52/232
2013/0269272 A1 * 10/2013 Turner ..... E04C 2/40 52/309.6
2014/0020915 A1 1/2014 Lopes
2014/0137494 A1 5/2014 Stahl, Jr. et al.
2014/0360115 A1 12/2014 Stahl, Jr.
2015/0007515 A1 1/2015 Stahl, Jr.
2015/0047276 A1 2/2015 Gandolfo et al.
2015/0240488 A1 * 8/2015 Evensen ..... E06B 7/14 52/235
2015/0284950 A1 * 10/2015 Stramandinoli ..... E04B 2/90 52/235
2016/0222653 A1 * 8/2016 Niehaus ..... E04B 2/967
2016/0356034 A1 * 12/2016 Andresen ..... E04B 2/90
2017/0145685 A1 * 5/2017 Andresen ..... E04B 2/96
2017/0284085 A1 10/2017 Ting
2017/0370097 A1 * 12/2017 Schulz-Hanke ..... E04F 13/007
2018/0030724 A1 * 2/2018 Schulz-Hanke ..... E04B 1/948
2018/0163397 A1 * 6/2018 Long ..... E04B 1/941
2018/0258634 A1 * 9/2018 Schulz-Hanke ..... E04B 2/88
2019/0063064 A1 * 2/2019 Paetow ..... E04B 1/948
2019/0284798 A1 * 9/2019 Klein ..... E04B 1/94

(56) References Cited

U.S. PATENT DOCUMENTS

| | | | | |
|---|---|---|---|---|
| 2020/0056371 | A1 | 2/2020 | Zemler et al. | |
| 2020/0263417 | A1 | 8/2020 | Zemler et al. | |
| 2020/0330803 | A1* | 10/2020 | Stahl, Jr. | E04B 2/90 |
| 2020/0332525 | A1* | 10/2020 | Klein | E04B 2/96 |

FOREIGN PATENT DOCUMENTS

| | | |
|---|---|---|
| CA | 2 849 597 | 12/2014 |
| GB | 2503465 | 1/2014 |
| JP | 2011-190613 | 9/2011 |
| JP | 2011-190614 | 9/2011 |
| JP | 2012-225082 | 11/2012 |
| KR | 10-1168757 | 7/2012 |
| WO | 2007/061572 | 5/2007 |
| WO | 2014/081446 | 5/2014 |
| WO | 2015/023313 | 2/2015 |

OTHER PUBLICATIONS

Written Opinion dated Aug. 23, 2018 in PCT/EP2018/063081.
Document 6, Filed Oct. 27, 2022, "First Amended Complaint for Patent Infringement" in Case 1:22-cv-01383-CFC (in the U.S. District Court for the District of Delaware).
Exhibit 1 to Document 6, Filed Oct. 27, 2022, "First Amended Complaint for Patent Infringement" in Case 1:22-cv-01383-CFC (in the U.S. District Court for the District of Delaware).
Exhibit 2 to Document 6, Filed Oct. 27, 2022, "First Amended Complaint for Patent Infringement" in Case 1:22-cv-01383-CFC (in the U.S. District Court for the District of Delaware).
Exhibit 3 to Document 6, Filed Oct. 27, 2022, "First Amended Complaint for Patent Infringement" in Case 1:22-cv-01383-CFC (in the U.S. District Court for the District of Delaware).
Exhibit 4 to Document 6, Filed Oct. 27, 2022, "First Amended Complaint for Patent Infringement" in Case 1:22-cv-01383-CFC (in the U.S. District Court for the District of Delaware).
Exhibit 5 to Document 6, Filed Oct. 27, 2022, "First Amended Complaint for Patent Infringement" in Case 1:22-cv-01383-CFC (in the U.S. District Court for the District of Delaware).
Exhibit 6 to Document 6, Filed Oct. 27, 2022, "First Amended Complaint for Patent Infringement" in Case 1:22-cv-01383-CFC (in the U.S. District Court for the District of Delaware).
Exhibit 7 to Document 6, Filed Oct. 27, 2022, "First Amended Complaint for Patent Infringement" in Case 1:22-cv-01383-CFC (in the U.S. District Court for the District of Delaware).
Exhibit 8 to Document 6, Filed Oct. 27, 2022, "First Amended Complaint for Patent Infringement" in Case 1:22-cv-01383-CFC (in the U.S. District Court for the District of Delaware).
Exhibit 9 to Document 6, Filed Oct. 27, 2022, "First Amended Complaint for Patent Infringement" in Case 1:22-cv-01383-CFC (in the U.S. District Court for the District of Delaware).
Exhibit 10 to Document 6, Filed Oct. 27, 2022, "First Amended Complaint for Patent Infringement" in Case 1:22-cv-01383-CFC (in the U.S. District Court for the District of Delaware).
Exhibit 11 to Document 6, Filed Oct. 27, 2022, "First Amended Complaint for Patent Infringement" in Case 1:22-cv-01383-CFC (in the U.S. District Court for the District of Delaware).
Exhibit 12 to Document 6, Filed Oct. 27, 2022, "First Amended Complaint for Patent Infringement" in Case 1:22-cv-01383-CFC (in the U.S. District Court for the District of Delaware).
Exhibit 13 to Document 6, Filed Oct. 27, 2022, "First Amended Complaint for Patent Infringement" in Case 1:22-cv-01383-CFC (in the U.S. District Court for the District of Delaware).
Exhibit 14 to Document 6, Filed Oct. 27, 2022, "First Amended Complaint for Patent Infringement" in Case 1:22-cv-01383-CFC (in the U.S. District Court for the District of Delaware).
Exhibit 15 to Document 6, Filed Oct. 27, 2022, "First Amended Complaint for Patent Infringement" in Case 1:22-cv-01383-CFC (in the U.S. District Court for the District of Delaware).
Exhibit 16 to Document 6, Filed Oct. 27, 2022, "First Amended Complaint for Patent Infringement" in Case 1:22-cv-01383-CFC (in the U.S. District Court for the District of Delaware).
Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 1 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 2 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 3 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 4 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 5 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 6 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 7 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 8 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 9 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 10 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 11 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).
Exhibit 12 to Document 16, Filed Dec. 19, 2022, "Specified Technologies, Inc.'s Answer to First Amended Complaint for Patent Infringement, Defenses, and Counterclaims" in Case 1:22-cv-01383-CFC (in the U.S. District Court for the District of Delaware).

* cited by examiner

PROCESS FOR ASSEMBLING A UNITIZED PANEL FOR USE WITHIN AN EXTERIOR DYNAMIC CURTAIN WALL ASSEMBLY

CROSS-REFERENCE TO RELATED APPLICATIONS

This application is a Continuation-in-Part of U.S. application Ser. No. 15/929,347, filed Apr. 28, 2020, which is a Continuation of U.S. application Ser. No. 16/610,420, filed Nov. 1, 2019, which is a National Stage entry under § 371 of International Application No. PCT/EP2018/063081, filed on May 18, 2018, and which claims the benefit of U.S. Utility application Ser. No. 15/600,295, filed on May 19, 2017.

FIELD OF THE INVENTION

The present invention relates to the field of constructions, assemblies and systems designed to thermally and acoustically insulate and seal a safing slot area defined between a curtain wall and the individual floors of a building. In particular, the present invention relates to a process for assembling a unitized panel for use within an exterior dynamic curtain wall assembly, which includes glass, especially vision glass extending to the finished floor level below. Further, the present invention relates to a unitized panel assembled according to said process and its installation to improve fire stopping at the safing slot.

BACKGROUND OF THE INVENTION

Curtain walls are generally used and applied in modern building constructions and are the outer covering of said constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

Due to the recent developments on the building construction market, unitized panels play an important role when a curtain wall is built-up. The use of unitized panels make installation of a curtain wall easier to the installer, as the pre-assembled curtain wall panel will be quickly installed on the jobsite. Unitized panels are built offsite in a curtain wall manufacturing facility. These unitized panels are then assembled in a controlled manufacturing process and shipped to the construction jobsite where they will be hung on the building. This process is highly desirable since it allows for quick and clean installation of the unitized panel on the jobsite when compared, for example, to the used stick build façade construction. Further, this pre-manufacturing of unitized panels ensures the quality of fire protection that is required according to various standards.

In general, a glass curtain wall structure or glass curtain wall construction is defined by an interior wall glass surface including one or more framing members and at least one floor spatially disposed from the interior wall surface. The gap between the floor and the interior wall surface of a curtain wall defines a safing slot, also referred to as perimeter slab edge (void), extending between the interior wall surface of the curtain wall construction and the outer edge of the floor. This sating slot is essential to slow the passage of fire and combustion gases between floors. Therefore, it is of great importance to improve fire stopping at the safing slot in order to keep heat, smoke and flames from spreading from one floor to an adjacent floor. It is important to note that the firestop at the perimeter slab edge is considered a continuation of the fire-resistance-rating of the floor slab. In general, the standard fire test method NFPA 285 provides a standardized fire test procedure for evaluating the suitability of exterior, non-load bearing wall assemblies and panels used as components of curtain wall assemblies, and that are constructed using combustible materials or that incorporate combustible components for installation on buildings where the exterior walls have to pass the NFPA 285 test.

In order to obtain certified materials, systems and assemblies used for structural fire-resistance and separation of adjacent spaces to safeguard against the spread of fire and smoke within a building and the spread of fire to or from the building, the International Building Code IBC 2012 provides minimum requirements to safeguard the public health, safety and general welfare of the occupants of new and existing buildings and structures. According to the International Building Code IBC 2012 Section 715.4, voids created at the intersection of the exterior curtain wall assemblies and such floor assemblies shall be sealed with an approved system to prevent the interior spread of fire where fire-resistance-rated floor or floor/ceiling assemblies are required. Such systems shall be securely installed and tested in accordance with ASTM E 2307 to provide an F-rating for a time period at least equal to the fire-resistance-rating of the floor assembly.

However, there is a code exception that states that voids created at the intersection of the exterior curtain wall assemblies and such floor assemblies, where the vision glass extends to the finished floor level, shall be permitted to be sealed with an approved material to prevent interior spread of fire. Such material shall be securely installed and capable of preventing the passage of flame and hot gasses sufficient to ignite cotton waste when subjected to ASTM E 119 time-temperature fire conditions under a minimum positive pressure differential of 0.01 inch of water column for the time period at least equal to the fire-resistance-rating of the floor assembly.

Although some glass and frame technologies have been developed that are capable of passing applicable fire test and building code requirements, there is hardly any system that addresses the exception stated in the International Building Code IBC 2012 Section 715.4 and fulfills the code section ASTM E 2307 full-scale testing.

However, there is no system known of which parts can be pre-assembled that addresses above mentioned exception and at the same time complies with the requirements according to ASTM Designation: E 1399-97 (Reapproved 2005), in particular having a movement classification of class IV, when finally installed. Class IV is a combination of thermal, wind, sway and seismic movement types. These have been tested according to the invention in both horizontal and vertical conditions. The E 1399, Standard Test Method for Cyclic Movement and Measuring the Minimum and Maximum Joint Widths of Architectural Joint Systems, is used for simulation of movements of the ground, such as for example an earthquake, or even movements under high wind load or life load. In particular, there is no system known that is used in a curtain wall structure that provides a dynamic system complying with ASTM E 1399, such as for example a curtain wall structure defined by an interior wall surface, which includes an interior panel, such as a back pan, extending over the interior surface thereof and at least one floor spatially disposed from the inner wall surface, thereby sealing of the safing slot between the floor and the back pan of this curtain wall, which extends between the interior wall surface of the interior panel and the outer edge of the floor, in particular when vision glass is employed. Said safing slot is needed to compensate dimensional tolerances of the concreted floor and to allow movement between the floor and the façade element caused by load, such by life, seismic or wind load.

Due to the increasingly strict requirements regarding fire-resistance as well as horizontal and vertical movement, there is a need for a dynamic, thermally and acoustically insulating and sealing system for a curtain wall structure that is capable of meeting or exceeding existing fire test and building code requirements and standards including existing exceptions and which can be easily installed on the jobsite. In particular, there is a need for a pre-manufactured unitized panel, ready to be installed on the jobsite, that prevents in its final installation the spread of fire when vision glass of a curtain wall structure extends to the finished floor level below even when exposed to certain movements (complying with the requirements for a class IV movement).

In view of the above, it is an object of the present invention to provide a process for assembling a unitized panel for use within an exterior dynamic curtain wall assembly, which includes glass, especially vision glass extending to the finished floor level below.

Further, it is an object of the present invention to provide a unitized panel that is full-scale ASTM E 2307 as well as ASTM E 1399 tested, to address the code exception, to avoid letters and engineering judgments, and to secure and provide defined/tested architectural detail for this application, in particular, by providing a tested panel for fire—as well as movement-safe architectural compartmentation and which makes it easier for the installers to build up the curtain wall on the jobsite.

Still further, it is an object of the present invention to provide a process for installing the unitized panel of the invention to improve fire stopping at the safing slot of an exterior dynamic curtain wall assembly.

Still further, it is an object of the present invention to provide at the same time a unitized panel, which is used as an acoustic insulating and sealing system for effectively acoustically insulating and sealing of the safing slot between a curtain wall structure and the edge of a floor.

These and other objectives as they will become apparent from the ensuring description of the invention are solved by the present invention as described in the independent claims. The dependent claims pertain to preferred embodiments.

SUMMARY OF THE INVENTION

In one aspect, the present invention provides a process for assembling a unitized panel for use within an exterior dynamic curtain wall assembly. In particular, it is an aspect of the present invention to provide such a process comprising the following steps:

- assembling the frame for the unitized panel by fastening the left and right vertical framing members and upper and lower horizontal framing members together;
- installing the anchor brackets to the upper locations of the vertical framing members ready for mounting the finished unitized panel to the building structure;
- installing the appropriate water gasket seals to the framing members to seal the unitized panel and building structure from water intrusion;
- installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to the upper horizontal framing member and upper locations of the vertical framing members and the first leg of the second L-shaped member is connected to the second leg of the first L-shaped member, thereby forming a substantially U-shaped cavity;
- installing supporting and attachment elements to fasten the substantially U-shaped cavity to an inner facing side of the vertical framing member, thereby forming a 5-sided box pan;
- installing additional gaskets, hardware, and components necessary to prepare the unitized panel for glass installation;
- completion of the unitized panel by installing glass and appropriate sealing layers to the unitized panel; and
- optionally installing a thermally resistant material into the substantially U-shaped cavity.

In another aspect, the present invention provides a process for installing the unitized panel to improve fire stopping at the safing slot of an exterior dynamic curtain wall assembly.

In yet another aspect, the present invention provides a unitized panel assembled according to said process.

In yet another aspect, the present invention provides a unitized panel which is used as an acoustic insulating and sealing system within an exterior dynamic curtain wall assembly.

In yet another embodiment, a zero-spandrel design (or box assembly) includes a box configured to be installed on a curtain wall, a door enclosing an interior space of the box, an opener configured to open the door, and an insulation material in the interior space of the box. In one embodiment, the box may include at least one flange configured for coupling to a frame of the curtain wall.

The insulation material is in a compressed state in the interior space when the door is closed, and the insulation material is configured to transition to an uncompressed state when the opener opens the door. The insulation material is configured to at least partially extend from the interior space into, for example, a safing slot or building joint adjacent the curtain wall assembly when the box is in an installed state and the door is opened.

The insulation material may be in a block configuration when compressed in the interior space of the box, or the insulation material may be in another configuration (e.g., an accordion configuration) when in the compressed state in the interior space. When in an accordion configuration, the insulation material may correspond to a single length of material with turns or bends. In some cases, the insulation material may include at least two sections of material disposed in an accordion configuration. The insulation material may have a predetermined shape when at least partially extending from the interior space and transitioning to the uncompressed state.

The box assembly may further include a spring coupled to the insulation material, with the spring providing a force which assists the insulation material to at least partially extend from the interior space of the box.

The opener may be configured to rip a hole in the door to allow the insulation material to at least partially extend from the interior of the box and transition to the uncompressed state. In some cases, the opener may be configured to open the door about a rotational pivot point to allow the insulation material to at least partially extend from the interior of the box and transition to the uncompressed state. In some cases, the opener includes a string coupled to the door, where the string is configured to apply a force to rip hole in the door, to allow the insulation material to at least partially extend from the interior space and transition to the uncompressed state.

The insulation material may include a foam or other material which is or is not fire-resistant. In one embodiment, the insulation material includes an intumescent material.

BRIEF DESCRIPTION OF THE FIGURES

The subject matter of the present invention is further described in more detail by reference to the following figures.

DETAILED DESCRIPTION OF THE INVENTION

Figure 1:
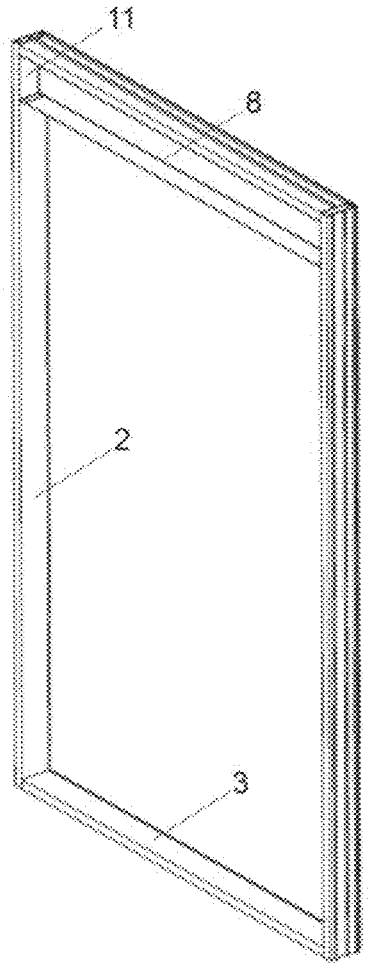
FIG. 1 shows a perspective view of a unitized panel for use within an exterior dynamic curtain wall assembly.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" or "curtain wall assembly" in context with the present invention refers to a wall structure defined by an interior wall surface including one or more framing members and at least one floor spatially disposed from the interior wall surface of the curtain wall construction. In particular, this refers to a glass curtain wall construction or glass curtain wall structure defined by an interior wall glass surface including one or more extruded framing members, preferably made of aluminum, and at least one floor spatially disposed from the interior wall glass surface.

The term "safing slot" in context with the present invention refers to the gap between a floor and the interior wall surface of the curtain wall construction as defined above; it is also referred to as "perimeter slab edge", extending between the interior wall surface of the curtain wall construction, i.e., vision glass and framing member, and the outer edge of the floor.

The term "zero spandrel" in context with the present invention refers to a horizontal framing member, also called transom, which is located at floor level, i.e., bottom of the transom at the level as top of the floor, preferably concrete floor.

The term "interior wall surface" in context with the present invention refers to the inner facing surface of the curtain wall construction as defined above, in particular, to the inner facing surface of the infilled vision glass and the inner facing surface of the framing members.

The term "cavity-shaped profile" in context with the present invention refers to any shaped profile that is capable of receiving a thermally resistant material for insulating. In particular, the cavity-shaped profile refers to a U-shaped profile, a trapezoidal-shaped profile, a triangular-shaped profile, rectangular-shaped profile, octagonal-shaped profile, preferably to a U-shaped cavity. These profiles can be formed from one or more components.

The unitized panel and its process for assembling according to the present invention is comprised of different elements which provide in accordance with each other for a system that addresses the code exception and meets the requirements of standard method ASTM E 2307 and complies with the requirements of standard method ASTM E 1399, and is described in the following:

According to the present invention, the process for assembling a unitized panel for use within an exterior dynamic curtain wall, comprises the following steps:

- assembling the frame for the unitized panel by fastening the left and right vertical framing members and upper and lower horizontal framing members together;
- installing the anchor brackets to the upper locations of the vertical framing members ready for mounting the finished unitized panel to the building structure;
- installing the appropriate water gasket seals to the framing members to seal the unitized panel and building structure from water intrusion;
- installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to the upper horizontal framing member and upper locations of the vertical framing members and the first leg of the second L-shaped member is connected to the second leg of the first L-shaped member, thereby forming a substantially U-shaped cavity;
- installing supporting and attachment elements to fasten the substantially U-shaped cavity to an inner facing side of the vertical framing member, thereby forming a 5-sided box pan;
- installing additional gaskets, hardware, and components necessary to prepare the unitized panel for glass installation;
- completion of the unitized panel by installing glass and appropriate sealing layers to the unitized panel; and
- optionally installing a thermally resistant material into the substantially U-shaped cavity.

In particular, in a first step the frame for the unitized panel is assembled by fastening the left and right vertical framing members and upper and lower horizontal framing members together using conventional fastening and assembling means for building the frame of unitized panels. Usually, rectangular aluminum tubing mullions and transoms are sized according to the curtain wall system manufacturer's guidelines that will manufacture the unitized panels.

In a second step, the anchor brackets are installed to upper locations of the vertical framing member ready for mounting the finished unitized panel to the building structure, followed by a third step wherein the appropriate water gasket seals are installed to the framing members to seal the unitized panel and building structure from water intrusion.

In a fourth step, the substantially U-shaped cavity is created by installing a first L-shaped member of a non-combustible material having a first leg and a second leg perpendicular to each other, and a second L-shaped member of a non-combustible material having a first leg and a second leg perpendicular to each other, such that the first leg of the first L-shaped member is fastened to the upper horizontal framing member and upper locations of the vertical framing members and the first leg of the second L-shaped member is connected to the second leg of the first L-shaped member. The connection of the two L-shaped members van be made via one or more screws, pins, bolts, anchors and the like. The back of the U-shaped cavity is positioned spatially disposed from the interior wall surface of the curtain wall construction, preferably spatially disposed from the inner surface of the vision glass infill.

This U-shaped cavity is considered for the purpose of facilitating fire stopping by receiving and encasing a thermally resistant material positioned in a safing slot present in those buildings utilizing pre-manufactured unitized panels, in particular glass panels in glass curtain wall structures, wherein the vision glass extends to the finished floor level, i.e., in the zero spandrel area of a glass curtain wall construction including only vision glass.

It is preferred that the L-shaped members are comprised of non-combustible material, preferably a metal material, most preferably steel, galvanized or plain. In a most preferred embodiment, the L-shaped members are made of a 12 or 18 gauge galvanized steel material or aluminum, such as an extruded aluminum. However, it is also possible that L-shaped members are comprised of a composite material or a material which is fiber-reinforced.

In one embodiment, the first leg of the first L-shaped member has a length of about 3 inch and a second leg of the first L-shaped member has a length of about 6 inch, and a first leg of the second L-shaped member has a length of about 1 inch and a second leg of the second L-shaped member has a length of about 3 inch. In an alternative embodiment, the first leg of the first L-shaped member has a length of about 3 inch and a second leg of the first L-shaped member has a length of about 1 inch, and a first leg of the second L-shaped member has a length of about 6 inch and a second leg of the second L-shaped member has a length of about 3 inch.

However, it is also possible to form the cavity-shaped profile using one or more pieces which are bent or somehow fastened together to form the various profiles, such as a trapezoidal-shaped profile, a triangular-shaped profile, rectangular-shaped profile, or octagonal-shaped profile for receiving a thermally resistant material for insulating. The U-shaped cavity can be designed using various number of pieces. It can be constructed using a single piece but the cost will increase due to the complexity and number of required bends.

Preferably, the U-shaped cavity is formed from two L-shaped members, wherein the first leg of the first L-shaped member has a length of about 3 inch and a second leg of the first L-shaped member has a length of about 1 inch, and a first leg of the second L-shaped member has a length of about 6 inch and a second leg of the second L-shaped member has a length of about 3 inch, making it easy for the manufacturer to assemble the unitized panel. In particular, the curtain wall manufacturer does not need to flip the curtain wall to gain access to the zero spandrel attachments.

Fastening of the two L-shaped members may be performed by fastening means selected from the group consisting of pins, expansion anchors, screws, screw anchors, bolts and adhesion anchors. Preferably fastening is performed by No. 10 self-drilling sheet metal screws. It is preferred that the fastening of the first L-shaped member takes place through the first leg and is fastened to the bottom of the horizontal framing member of the curtain wall construction. However, any other suitable fastening region may be chosen as long as maintenance of complete sealing of the safing slot is guaranteed.

In a next step, elements for supporting and attaching are installed to fasten the substantially U-shaped cavity to an inner facing side of the vertical framing member. Preferably, these elements have a substantially L-shaped profile and are positioned so that the gap between U-shaped cavity and the vertical framing member is closed due to the architectural structure of the glass curtain wall assembly, thereby forming a 5-sided box pan.

It is preferred that elements for supporting and attaching are comprised of a non-combustible material, preferably a metal material, most preferably steel. In a particular preferred embodiment of the present invention, these elements are angle brackets made from a 12 or 18 gauge galvanized steel material or aluminum, such as an extruded aluminum. In a most preferred embodiment, a first leg of the angle bracket has a length of about 3 inch and a second leg of the angle bracket has a length of about 1 inch. Dimensions and geometric design of these elements may be varied and adapted to address joint width and mullion location in a degree known to a person skilled in the art.

Dimensions, material and geometric design of the complete U-shaped cavity, also referred to as 5-sided box pan or zero spandrel box, may be varied and adapted to address joint width and transom location in a degree known to a person skilled in the art.

In a sixth step, additional gaskets, hardware, and components necessary to prepare the unitized panel for glass installation are installed according to the curtain wall manufacture's guidelines; followed in a seventh step by completion of the unitized panel by installing glass and appropriate sealing layers to the unitized panel.

The so assembled unitized panel may be complemented with a thermally resistant material installed into the substantially U-shaped cavity. In particular, the thermally resistant material that can be installed into the substantially U-shaped cavity is a thermally resistant flexible material such as a mineral wool material, most preferably is a mineral wool bat insulation having a 3 inch thickness, 8-pcf density, installed with no compression. However, in order to use this panel within an exterior dynamic curtain wall assembly it is not essential to install the curtain wall before transporting the assembled panel to the jobsite.

Once the unitized panel is assembled according to the above-described process, it is ready for installation to improve fire stopping at the safing slot of an exterior dynamic curtain wall assembly. In particular, this process comprises the following steps;

hanging the unitized panel to the building structure;

installing a thermally resistant material in the safing slot; and applying an outer fire retardant coating positioned across the thermally resistant material installed in the safing slot and the adjacent portions of the vertical and horizontal framing members and the floor located thereadjacent.

Once the unitized panel is delivered to the jobsite, the panel is simply hung on the building and a thermally resistant material is installed in the safing slot. Preferably, the thermally resistant material is a thermally resistant flexible mineral wool and installed with fibers running parallel to the outer edge of the floor and the curtain wall. Moreover, it is preferred that a min. 4 inch thick, 4-pcf density, mineral wool bat insulation is employed, if the U-shaped cavity of the unitized panel is already filled with an insulating material and most preferably installed with 25% compression in the nominal joint width. The mineral wool bat is to be installed flush with the top surface of the concrete floor. Splices, also referred to as butt joints in the lengths of the mineral batt insulation are to be tightly compressed together.

In case the U-shaped cavity of the unitized panel has not been filled with a thermally resistant material before delivering it to the jobsite, insulation of the safing slot is ensured by filling the cavity to a depth of 2⅞ inch with 4-pcf density mineral wool batt insulation with the fibers running parallel to the floor and compressing the packing material 25% vertically in the U-shaped cavity. This step is followed by installation of a thermally resistant material as above installed in the safing slot.

In order to finalize complete fire protection of the safing slot, in particular in front of the vertical framing members, a further thermally resistant material for insulating may be positioned in the safing slot in abutment with respect to the vertical framing member, i.e. located in front of the vertical framing member.

It is preferred that the thermally resistant material for insulating is a thermally resistant flexible material such as a mineral wool material, to facilitate placement thereof into the safing slot and in front of the vertical framing member.

This thermally resistant flexible material can be integrally connected to the thermally resistant flexible material installed in the safing slot, and preferably made of a thermally resistant flexible mineral wool material installed with fibers running parallel to the outer edge of the floor. Moreover, it is preferred that a 12 inch long, 4-pcf density, mineral wool bat insulation is centered at the vertical framing member, i.e., mullion, and installed with 25% compression and depth to overcome the slab thickness. This installation is also referred to as the integrated mullion cover.

In a particular preferred embodiment, the insulation material in the safing slot is installed continuously and in abutment with respect to the outer edge of the floor, the filled U-shaped cavity, and the interior facing surface of the vertical framing member.

It is preferred that the upper as well as the lower primary surfaces of the filled U-shaped cavity and the insulation material in the safing slot are flush with respect to the upper and lower side of the floor, and the sides of the U-shaped cavity, respectively.

When installing, the insulating elements are compressed to varying degrees, but normally compressed to approximately 25% in comparison to a standard of 33%. This compression will cause exertion of a force outwardly against the other elements of the system in order to expand outwardly to fill voids created in the safing slot.

To improve fire stopping at the safing slot of an exterior dynamic curtain wall assembly, an outer fire retardant coating is applied and positioned across the thermally resistant material installed in the safing slot and the adjacent portions of the vertical and horizontal framing members and the floor located there adjacent. The sealing characteristics of the installed unitized panel within an exterior dynamic curtain wall assembly shown in the present invention are significantly enhanced by the application of such fire retardant coating.

Generally, such fire retardant coatings are applied by spraying or other similar means of application. Such fire retardant coatings, in particular outer fire retardant coatings, are for example firestop joint sprays, preferably based on water, and self-leveling silicone sealants. For example, Hilti Firestop Joint Spray CFS-SP WB can be used as an outer fire retardant coating in accordance with the present invention. In one preferred embodiment of the present invention the outer fire retardant coating is an elastomeric outer fire retardant coating, water-based or silicone-based outer fire retardant coating, preferably a firestop joint spray. The outer fire retardant coating that can be applied in the installed system of the present invention is preferably in the form of an emulsion, spray, coating, foam, paint or mastic.

According to one embodiment of the present invention, it is preferred that the outer fire retardant coating has a wet film thickness of at least ⅛ inch or 2 mm. Additionally, it is preferable that the outer fire retardant coating covers the top of the thermally resistant flexible mineral wool material overlapping the outer edge of the floor and the interior face of the vertical and the horizontal framing member surface of the curtain wall assembly by a min. of ½ inch. The outer fire retardant material can be applied across the insulation installed in the safing slot and the adjacent areas of the interior wall surface and floor.

According to the present invention, the process for assembling a unitized panel may further comprise the application of a silicone sealant, preferably a firestop silicon, in order to restrict air movement and to serve as a vapor barrier. The application of a silicone sealant allows the usage of an unfaced curtain wall insulating material, i.e., mineral wool without any foil or tape around the outside, in particular in cases, where the cavity-shaped profile consists of more the one pieces.

The unitized panel of the present invention is also for acoustically insulating and sealing of a safing slot of a curtain wall structure. The material used for insulating may be of a sound resistant and/or air tight material, such as a mineral wool material coated with an acrylic- or silicone-based material, rubber-like material or a foam, such for example an elastomeric interlaced foam based on synthetic rubber (Armaflex), a polyethylene foam, a polyurethane foam, a polypropylene foam or a polyvinyl chloride foam.

While the invention is particularly pointed out and distinctly described herein, a preferred embodiment is set forth in the following detailed description which may be best understood when read in connection with the accompanying drawings.

In FIG. 1 a perspective view of an assembled unitized panel for use within an exterior dynamic curtain wall assembly is depicted. The U-shaped cavity 8 and supporting and attachment elements 11 are installed to the vertical framing member 2 and to the horizontal framing member 3 within the zero-spandrel area of a curtain wall structure forming a 5-sided box pan 8 or also referred to as a zero spandrel box.

Figure 2:
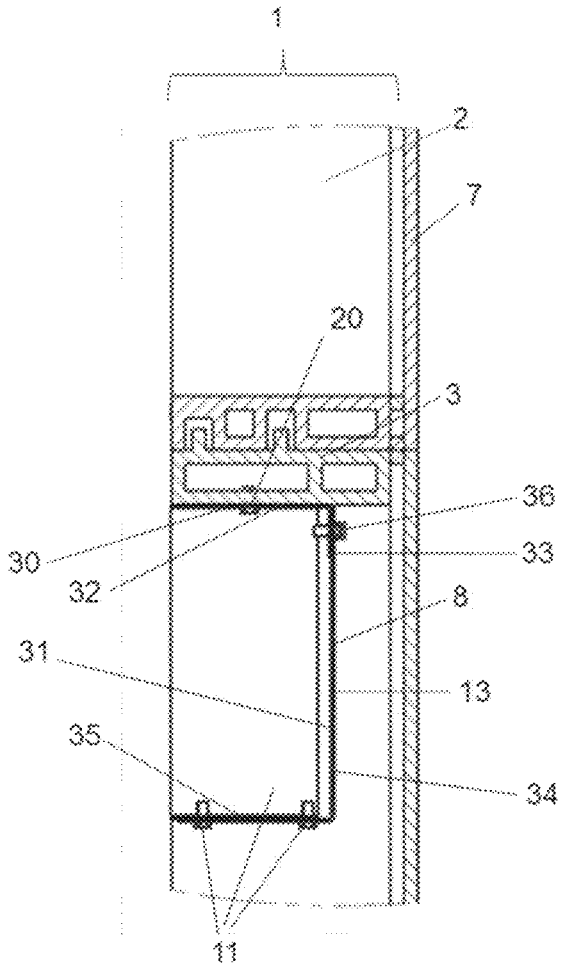
FIG. 2 shows a side cross-sectional detailed view of a unitized panel construction at a horizontal framing member (transom).

FIG. 2 shows side cross-sectional detailed view of a box assembly of a unitized panel construction at a horizontal framing member (transom). The detailed transom structures clearly depicts the U-shaped cavity within a unitized panel construction. The unitized glass curtain wall panel is defined by an interior wall surface 1 including one or more framing members, i.e., vertical framing member—mullion 2—and horizontal framing member—transom 3—which is located at the floor level when installed. The framing members 2 and 3 are infilled with vision glass 7 extending to the finished floor level below. The assembled unitized panel comprises a first L-shaped member 30 and a second L-shaped member 31 connected to each other to form the U-shaped cavity 8, made of a non-combustible material, such as metal, preferably made from an 18 gauge galvanized steel material, for receiving a thermally resistant material for insulating 9 (shown as dashed lines in FIG. 3).

Supporting and attachment elements 11 (partially shown in FIG. 2) fasten the substantially U-shaped cavity 8 of the box assembly to an inner facing side 12 of the vertical framing member 2. Elements 20 for fastening the U-shaped cavity to the upper horizontal framing member 3 and upper locations of the vertical framing member 2 are preferably No. 10 self-drilling sheet metal screws. The back 13 of the U-shaped cavity is positioned spatially disposed from the interior wall surface of the curtain wall construction, preferably spatially disposed from the inner surface of the vision glass infill 7. In particular, FIG. 2 shows that the first L-shaped member 30 has a first leg 32 and a second leg 33 perpendicular to each other, and the second L-shaped 31 member has a first leg 34 and a second leg 35 perpendicular to each other, wherein the first leg 34 of the second L-shaped member 31 is connected to the second leg 33 of the first L-shaped member 30, thereby forming a substantially U-shaped profile 8. The connection of the two L-shaped members 30, 31 occurs via a No. 10 self-drilling sheet metal screw 36. The L-shaped members 30, 31 are comprised of a non-combustible material, such as metal, preferably made from an 18 gauge galvanized steel material.

Figure 3:
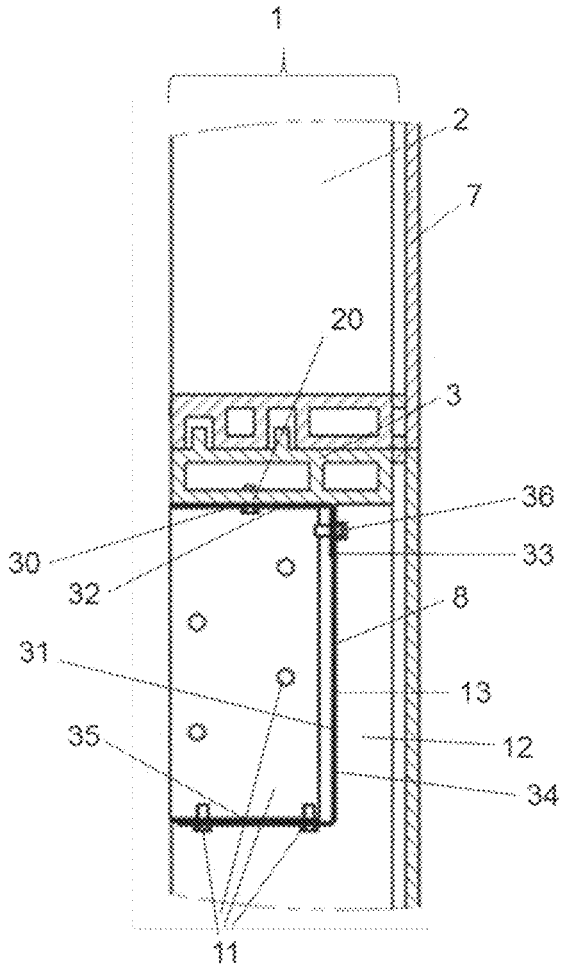
FIG. 3 shows a side cross-sectional detailed view of a unitized panel construction at vertical framing member (mullion).

FIG. 3 shows a side cross-sectional detailed view of a box assembly of a unitized panel construction at a horizontal framing member (transom). FIG. 3 shows supporting and attachment elements 11 (partially also shown in FIG. 2) for fastening the substantially U-shaped cavity 8 to an inner facing side 12 of the vertical framing member 2. The supporting and attachment elements 11 have a substantially L-shaped profile and are positioned so that the gap between U-shaped cavity 8 and the vertical framing member 2 is closed due to the architectural structure of the glass curtain wall assembly and is comprised of a non-combustible material, preferably a metal material, most preferably steel. As shown in FIG. 3, the supporting and attachment element 11 is an angle bracket made from 18 gauge galvanized steel material, preferably a first leg of the angle bracket has a length of about 3 inch and a second leg of the angle bracket has a length of about 1 inch. The elements for attachment are No. 10 self-drilling sheet metal screws. The other remaining elements of the unitized panel are the same as described for FIG. 2.

Figure 4:
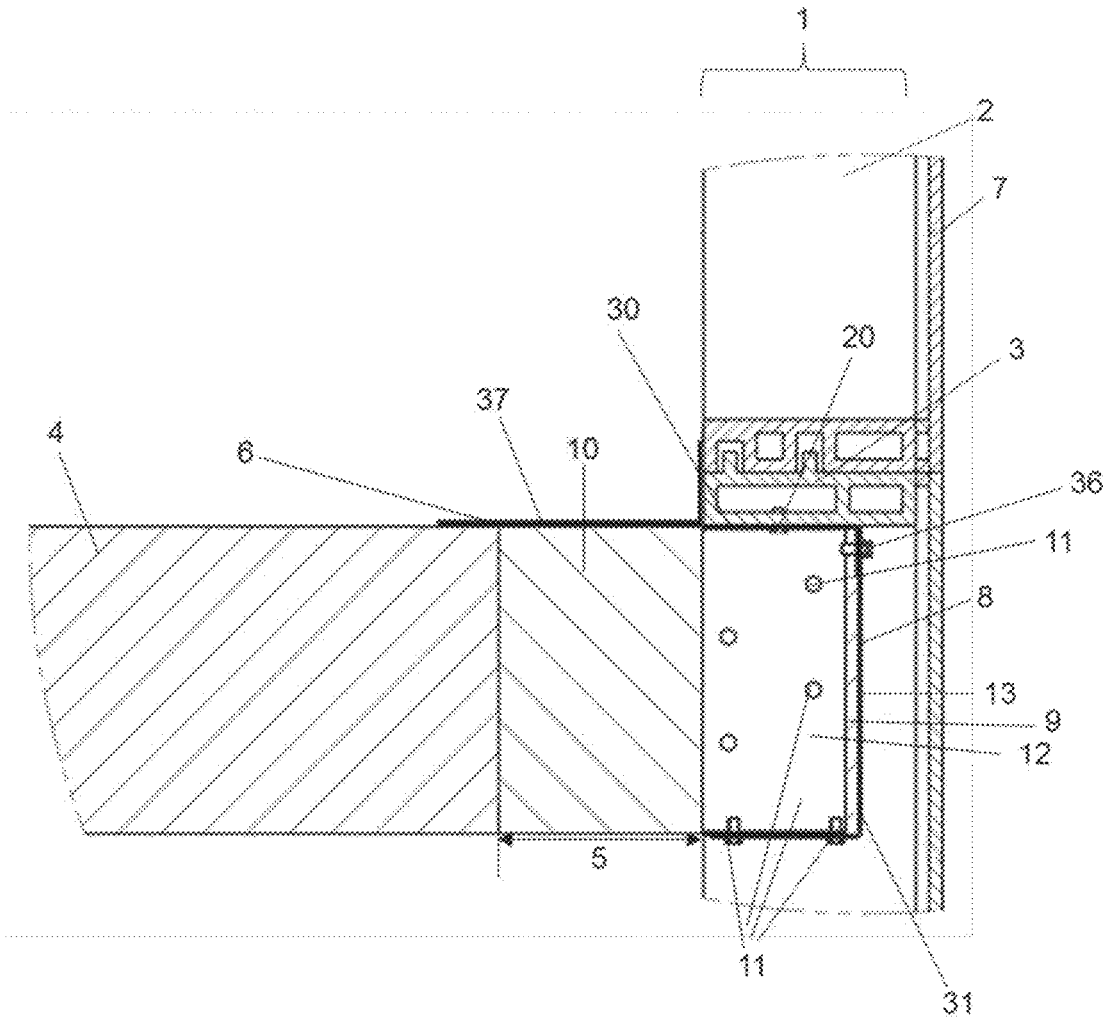
FIG. 4 shows the assembled unitized panel installed to improve fire stopping at the safing slot of an exterior dynamic curtain wall assembly.

FIG. 4 shows the assembled unitized panel including the box assembly installed to improve fire stopping at the safing slot 5 of an exterior dynamic curtain wall assembly. A thermally resistant material 9 for insulating is positioned in U-shaped cavity 8. The thermally resistant material 9 preferably fills the cavity to a depth of 2⅞ inch with 4-pcf density mineral wool batt insulation with the fibers running parallel to the floor and is compressed 25% vertically in the U-shaped cavity 8. Another thermally resistant material 10 is installed in the safing slot and is preferably mineral wool, preferably having a min. 4-pcf density and a thickness of 4 inch. Not shown in FIG. 4 is that the thermally resistant flexible mineral wool material 10 is installed with fibers running parallel to the outer edge 6 of the floor 4. To improve fire stopping at the safing slot of an exterior dynamic curtain wall assembly, an outer fire retardant coating 37 is applied and positioned across the thermally resistant material 10 installed in the safing slot 5 and the adjacent portions of the vertical 2 and horizontal framing members 3 and the floor 4 located thereadjacent. The other remaining elements are the same as described for FIGS. 2 and 3.

It should be appreciated that these embodiments of the present invention will work with many different types of insulating materials used for the insulating materials employed in the U-shaped cavity and within the safing slot as well as different types of the non-combustible material used for the 5-sided box pan as long as the material has effective high temperature insulating characteristics. Each unitized panel manufacturer has its own architectural design, which requires minor adjustments to the construction process. These include but are not limited to the water-tight gaskets, anchor bracket attachment method, and mullion/transom design.

The tested assembly using the assembled unitized panel achieved and an F-Rating of 120 min as well as a movement rating of class IV.

It has been shown that the unitized panel installed within an exterior dynamic curtain wall assembly of the present invention, maintains sealing of the safing slots surrounding the floor of each level in a building.

In particular, it has been demonstrated that the unitized panel installed within an exterior dynamic glass curtain wall assembly of the present invention is capable of meeting or exceeding existing fire test and building code requirements including existing exceptions. In particular, the system prevents the spread of fire when vision glass of a curtain wall structure extends to the finished floor level below, thereby addressing the architectural limitation of the width of a column or spandrel beam or shear wall behind the curtain wall. Additionally, maintaining sating insulation between the floors of a residential or commercial building and the exterior curtain wall responsive to various conditions including fire exposure is guaranteed.

Further, it has been shown, that the unitized panel installed within an exterior dynamic glass curtain wall assembly of the present invention meets the requirements of a full-scale ASTM E 2307 as well as full-scale ASTM E 1399 tested system for floor assemblies where the vision glass extends to the finished floor level, addressing the code exception, avoiding letters and engineering judgments and securing and providing defined/tested architectural detail for this application, in particular providing a tested system for fire- and movement-safe architectural compartmentation.

In particular, the tested system according to the present invention provides for the employment of reduced curtain wall insulation to only 6 inch height, resulting in up to 40% curtain wall material savings to the closest 10 inch spandrel system. Further, no top horizontal transom cover is needed for maximum vision glass/architectural exposure top of slab. Another great advantage of the unitized panel installed within an exterior dynamic curtain wall assembly of the present invention is that mineral wool is not exposed and does not need to be superior water resistant from all directions, no fiber distribution can occur to the air and no mineral wool is visible for architectural looks. Further, no stiffeners, hat channel, weld pins or similar means are needed to install/fasten the insulation, rather it can be simply fitted by friction fit. Additionally, the mineral wool is installed with only 25% compression, whereas standard systems require 33% compression.

Figure 5:
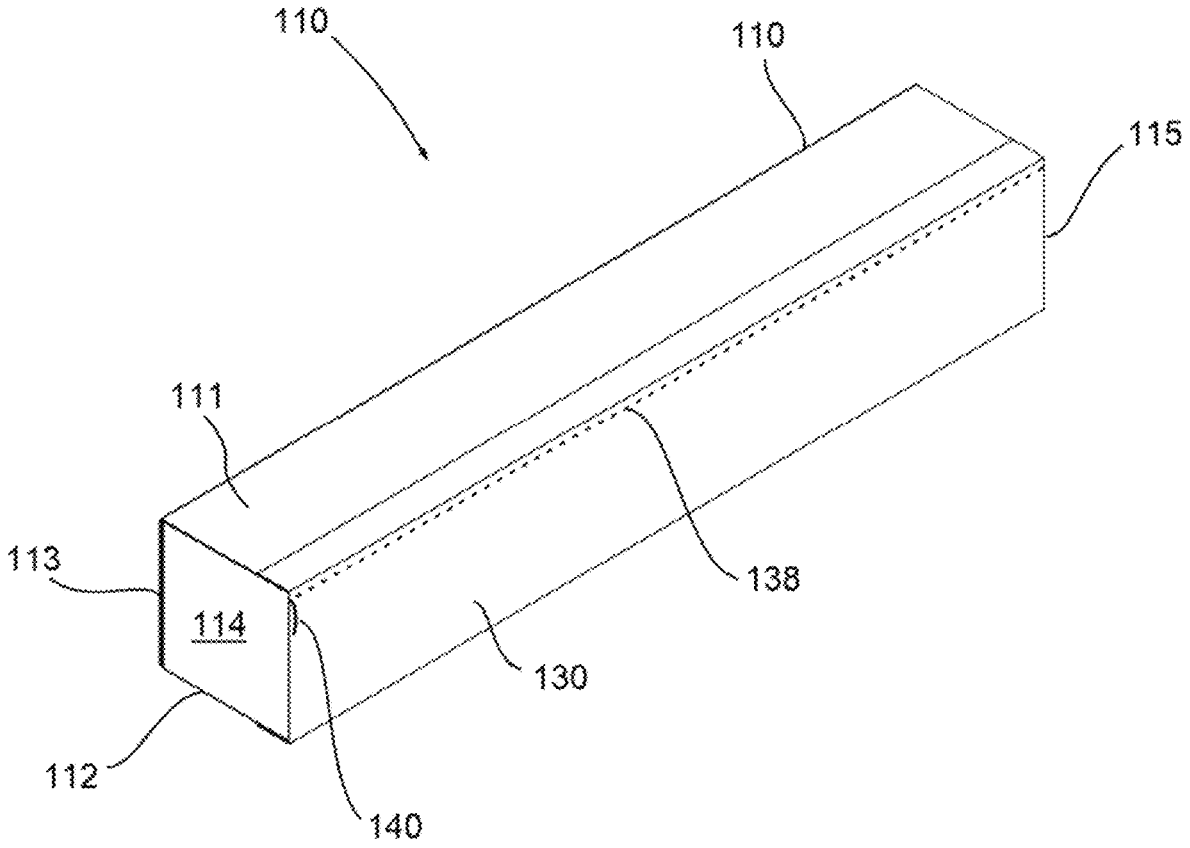
FIG. 5 shows a perspective view of another zero-spandrel design a unitized panel construction.

FIG. 5 shows a perspective view of another embodiment of a zero-spandrel box design 100. The zero-spandrel box design (or box assembly) 100 may be used as one component of a fire-resistant system. The fire resistant system may be included in a structure such as a building. For illustrative purposes, the zero-spandrel box design will be discussed as being used in a unitized panel mounted in a curtain wall assembly of a building. This description is given with the understanding that the zero-spandrel box design may be used in other applications.

Referring to FIG. 5, the zero-spandrel box design 100 includes a box (or box pan) 110, an insulation material 120, a door 130, and an opener 140. The box 110 can be constructed as a single component or may include two or more pieces coupled together. In some cases, a multiple-piece configuration of box 110 may be useful in assisting in installation.

In one embodiment, box 110 may correspond to the 5-sided box pan previously described with reference to FIGS. 2 to 4. In this case, box 110 may have a top side 111, a bottom side 112, and a vertical side 113 between the top side and the bottom side. The box may also include a first end 114 and a second end 115 coupled to the top side 111, the bottom side 112, and the vertical side 113 at opposing positions of the box. In one embodiment, ends 114 and 115 may be omitted. The five sides of the zero spandrel box design may be made of a variety of materials, e.g., aluminum, steel, or another metal or any of the materials previously discussed herein.

Together, the sides of box 110 create an interior space or cavity, which, for example, may correspond to U-shaped cavity 8 of the embodiments of FIGS. 2 to 4. (Of course, the interior space may also exist in other designs of box 110). The cavity may also be designed as discussed in relation to previous embodiments, e.g., with a certain area, depth, or volume sufficient to meet an intended application when installed, for example, between vertical and/or horizontal framing members (e.g., mullions and transoms) using supporting and attachment elements 11 having the substantially L-shaped profile. Once installed, a back pan of the box 110 may be insulated, for example, by mineral wood and/or other fire-resistant or insulative materials.

Figures 6A, 6B, 6C:
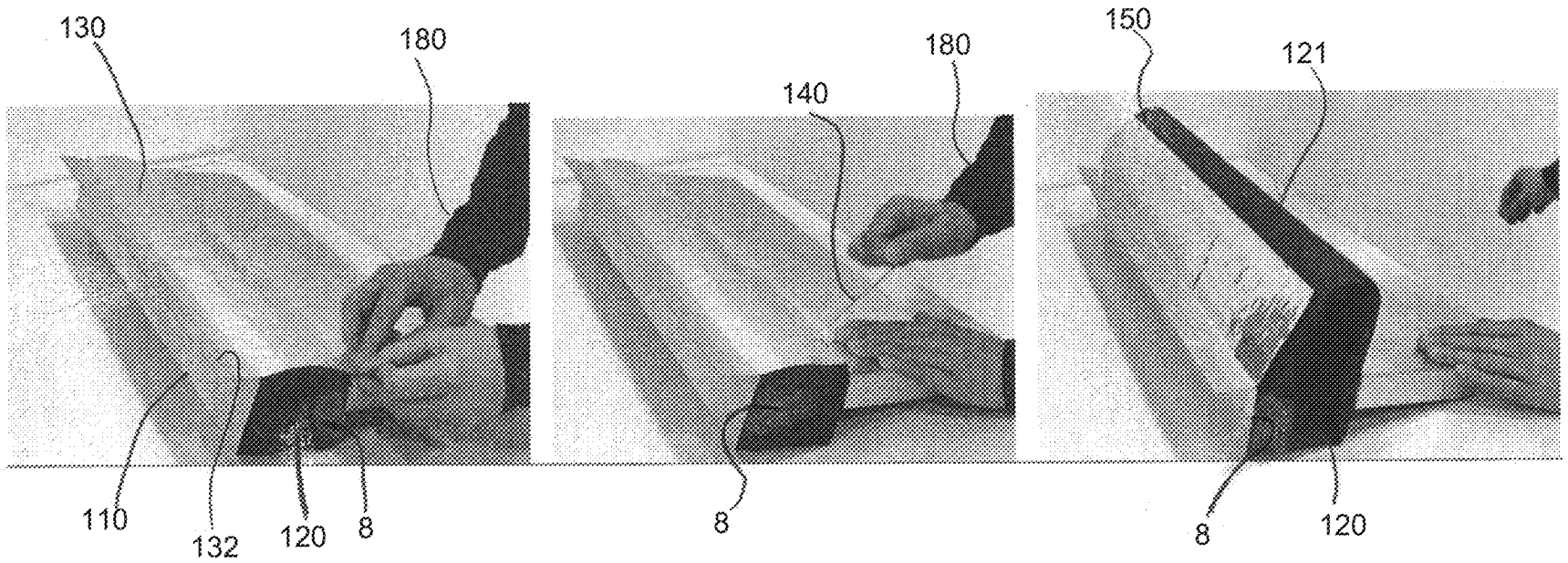
FIGS. 6A to 6C show an example of an opener of the zero-spandrel box design of FIG. 5.

The insulation material 120 is pre-compressed to fit within the cavity of the box 110 (e.g., see FIGS. 6A to 6C). The insulation material may be made of the same or a similar material to thermally resistant material 9. One example is Hilti PUMA material or Armaflex. In one embodiment, the insulation material 120 may be made from a material which is not thermally resistant. The amount of compression of insulation material 120 may depend, for example, on the density and flexibility of the insulation material and/or the extent to which the insulation material is to extend once the door 130 is opened.

In one embodiment, the insulation material 120 is made from foam or other compressible material that extends (or springs forth) into a curtain wall joint (e.g., safing slot 5, see FIG. 4) when the door 130 is opened and the insulation material transitions from a compressed state to an uncompressed state. An example of the release and movement of the insulation material is described with reference to FIGS. 6A to 6C.

In a 5-sided design, the door 130 may cover a sixth side of the box 100 and, for example, may be located at a position opposing side 113. The door 130 may be coupled to at least one side 111 or 112 of the box. In one embodiment, the door 130 corresponds to a side that is coupled to sides 111, 112, 114, and 115, in the event that the ends of the box are included. The door 130 may help to hold the insulation material 120 in a compressed state with the interior space 8 of the box 110.

In one embodiment, the door 130 may be made of the same material as the box 110. In another embodiment, the door 130 may be made from a different material, e.g., thin plastic sheet. In another embodiment, the door 130 may be a metal (e.g., steel) hinged door with a latch to allow for opening. For example, the door 130 may be adapted to open during or after installation of the zero-spandrel design into the building structure, e.g., when coupled to the dynamic curtain wall assembly.

The opener 140 may open the door 130 in various ways. In one embodiment, shown in FIG. 5, the opener 135 may include a string that spans an interior side of the door in substantial alignment with dotted line 138. When the string is pulled, a force is asserted by the string to rip a hole in the door 130. The hole may partially or entirely span the length of the door 130 to release the compressed insulation material 120 in the cavity 8.

When the opener 140 is a string, the material from which the door 130 is made may be selected to be torn by the string. Thus, for example, the door 130 may be made of aluminum, plastic, or another material which, at least in the area of the dotted line 138, gives way to form a hole (e.g., a slit) when force is applied by the opener. To allow for easier opening, the dotted line 138 may correspond to a series of perforations in the material of the door 130. In another embodiment, the dotted line is just provided for reference and does not actually appear on the surface of the door 130. The string may be made of twine, thread, plastic, cotton, synthetic fibers, or one or more other materials.

While the opener 140 has been described as including a string, the opener 140 may be different from a string in other embodiments. For example, the opener 140 may include a zipper, velcro, snaps, clips, tape, or another type of fastener that joins respective sides forming an opening of the door 130. In one embodiment, the opener 140 may correspond to a hinge or other rotatable fastener coupled to at least one side of the box 110 and which allows the box 110 to rotate (e.g., see arrow 760 in FIG. 7) to open the door 130 to release the insulation material 120 in the interior space. In accordance with one or more embodiments, a portion of the insulation material 120 may remain in the box 110 when transitioning to the uncompressed state.

In one embodiment, the zero-spandrel design (or box assembly) may be pre-installed within a unitized panel, for example, by a manufacturer or contractor. The unitized panel may then be installed in a curtain wall assembly on a building or other structure.

Preinstallation of the zero-spandrel design may increase efficiency by reducing the time of construction at the building site, e.g., preinstalling box assemblies into unitized panels allows contractors to install the panels without having to perform the extra step of installing the box assemblies at the work site. In another embodiment, the zero-spandrel design may be installed into unitized panels for a curtain wall assembly at the job site, for example, in order to allow for custom fitting.

FIGS. 6A to 6C show an example of how the opener 140 of FIG. 5 may be used to open the door 130. In FIG. 6A, the zero-spandrel box design 100 is shown in a closed state, e.g., a state where the door 130 is secured over the interior space or cavity 8 of box 110, e.g., the box of FIGS. 2 to 4. In this embodiment, the door may include one or more flanges 132. For illustrative purposes, in order to show release and extension of the compressed insulation material 120, ends 114 and 115 have been removed. Also, in this example, the box 110 is not located in the unitized panel in order to allow for improved viewing of the action that occurs when the door 130 is opened by the opener.

In FIG. 6B, an installer 180 locates and grabs the string that corresponds to the opener 140. When the installer pulls the string, a force applied by the string rips a hole 150 in the material of the door 130 in a lengthwise direction of the box 110. In one embodiment, the box 110 may be coupled to the vertical and/or horizontal framing members before the opener is used to open the door 130. This may be accomplished, for example, the supporting and/or attachment elements 11.

In some cases, at least some of the supporting and/or attachment elements 11 may pass through holes in the one or more flanges 132 to accomplish installation. When the box 110 is coupled to the horizontal and/or vertical framing members prior to using the opener, this coupling or installation may provide additional stability and a counterforce to the pulling action of the string 140, which, in turn, may allow the string to more effectively create the hole in the door 130 to release the insulation material 120. In one embodiment, the string may be used to open the door 130 of the box 110 before it is installed in the unitized panel, either before or after the panel is installed in the curtain wall assembly.

In FIG. 6C, the door 130 transitions to an open state when the installer 180 is finished pulling the string to the full extent of the length of the box 110. In the open state, the pre-compressed insulation material 120 transitions to an uncompressed state, where a forward edge 121 of the pre-compressed insulation material extends forth in a direction away from the internal cavity 8 to fill a predetermined area, which, for example, may be safing slot 5 between the curtain wall assembly and a floor 4 (e.g., see FIG. 4). In another embodiment, the predetermined area may be different from a safing slot depending, for example, on the intended application.

The forward edge 121 of the insulation material 120 may have a predetermined shape, for example, in order to fill or otherwise occupy the predetermined area. In FIG. 6*c*, the forward edge 121 is shown to have a rounded edge. In another embodiment, the forward edge may be slanted or pointed or may have another shape. When the insulation material 120 extends into the predetermined area, it may apply a force to push the door 130 to one side.

Figure 7:
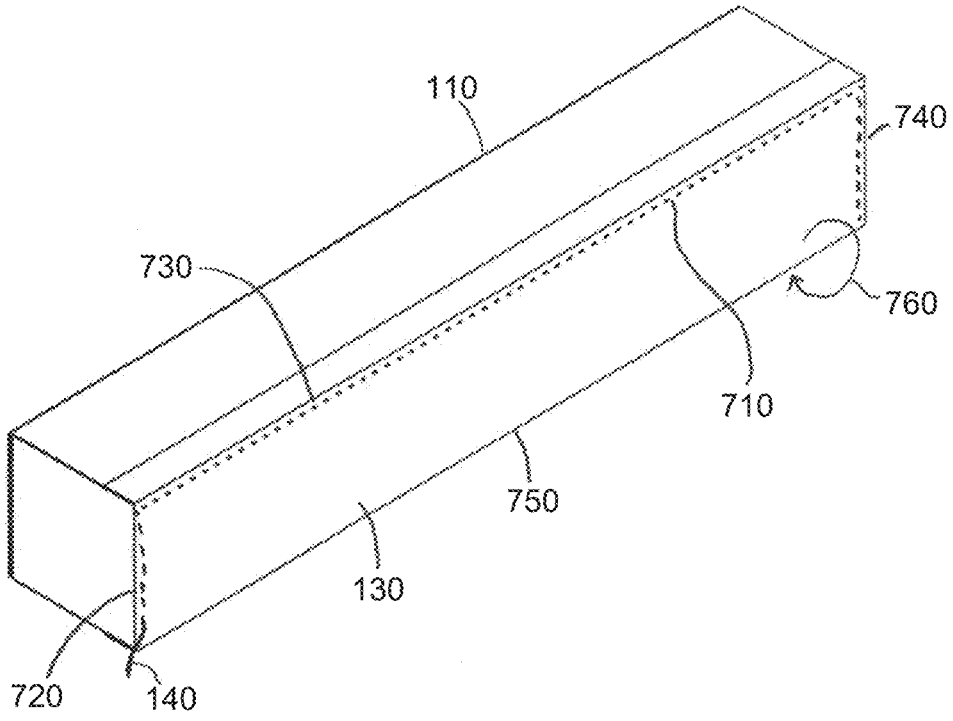
FIG. 7 shows an example of an alternative placement of a opener of the zero-spandrel box design.

In FIGS. 6A to 6C, the string of the opener 130 is shown to start and end at opposing positions of the door 130. In one embodiment, the string may be disposed along three of the four surfaces (or perimeter) of the door 130 in order to allow the insulation material 120 to be released. An example is shown in FIG. 7, wherein the dotted line 710 shows the placement of the string along the interior surface of the door 130. When pulled, the string rips open a hole that traverses sides 720, 730, and 740, but does not rip open side 750 in order to allow the door 130 to swing open (e.g., rotate to an open position) relative to this side.

Figure 8B:
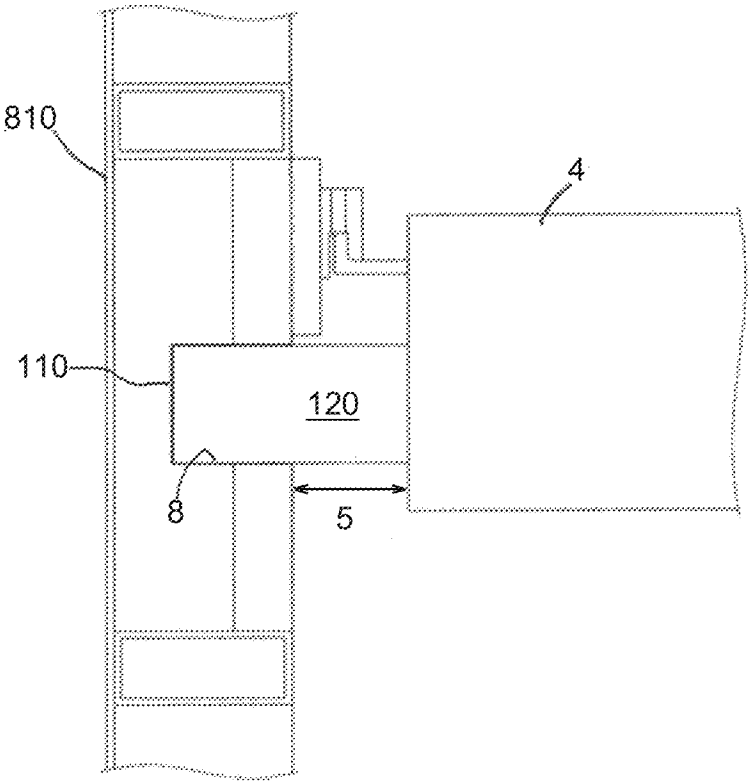
FIGS. 8A and 8B show examples of opened and closed states the zero-spandrel design when installed in a curtain wall assembly of a budding.
Figure 8A:
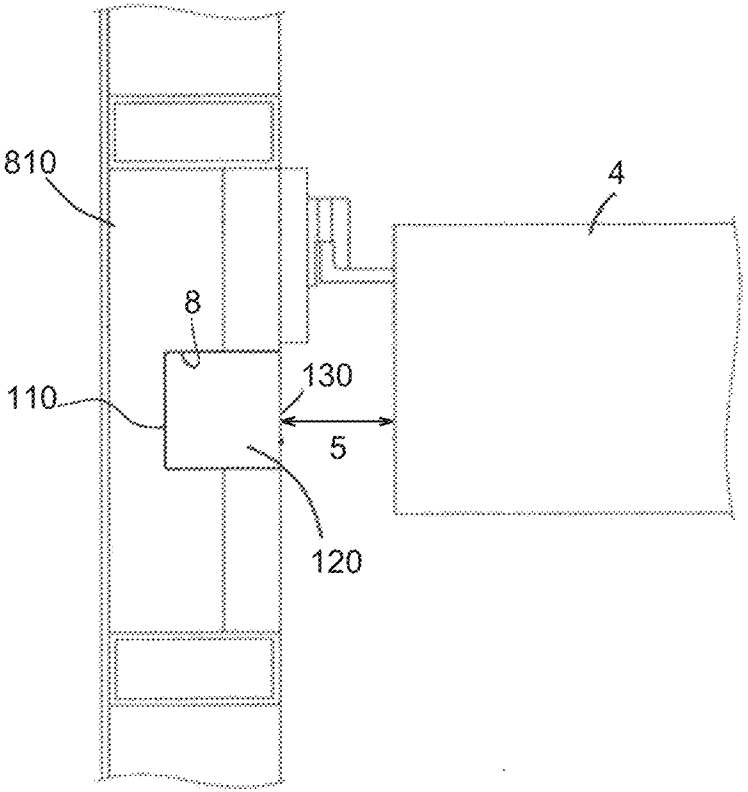

FIGS. 8A and 8B show examples of closed and open states of the door 130 of the zero-spandrel design (or box assembly) when installed in a curtain wall assembly of a building. In FIG. 8A, the box 110 of the zero-spandrel design is installed in a unitized panel coupled to a curtain wall assembly 810, for example, as described with respect to FIGS. 2 to 4. In this example, the box 110 is installed in the closed state, e.g., door 130 is closed because the opener 140 has not been activated. The position of the box 110 is in horizontal alignment with floor 4, with safing slot 5 disposed therebetween.

In FIG. 8B, an installer activates the opener 140 (e.g., by pulling the string as previously described) to open the door 130 of the box 110. Opening the door 130 causes the insulation material 120 to decompress and extend in a direction toward the floor 4 and fill (or at least substantially so) the safing slot 5, thereby providing protection against propagation of fire, smoke, and noise above and below areas of the floor 4 of the building. In the example of FIG. 8B, the door 130 been ripped off the box 110 by the installer, for example, by a perforation that may extend along a bottom side 150 of the door 130. If the door 130 is left to remain, it may be bent or defected to an area below the insulation material 120 in the safing slot 5.

Figure 9B:
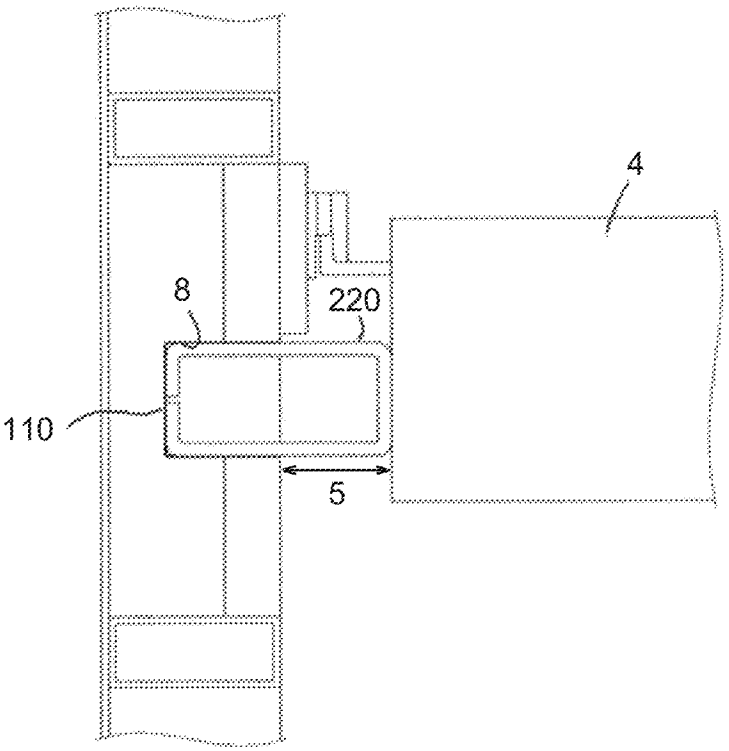
FIGS. 9A and 9B show another embodiment of a zero-spandrel design for a unitized panel construction.
Figure 9A:
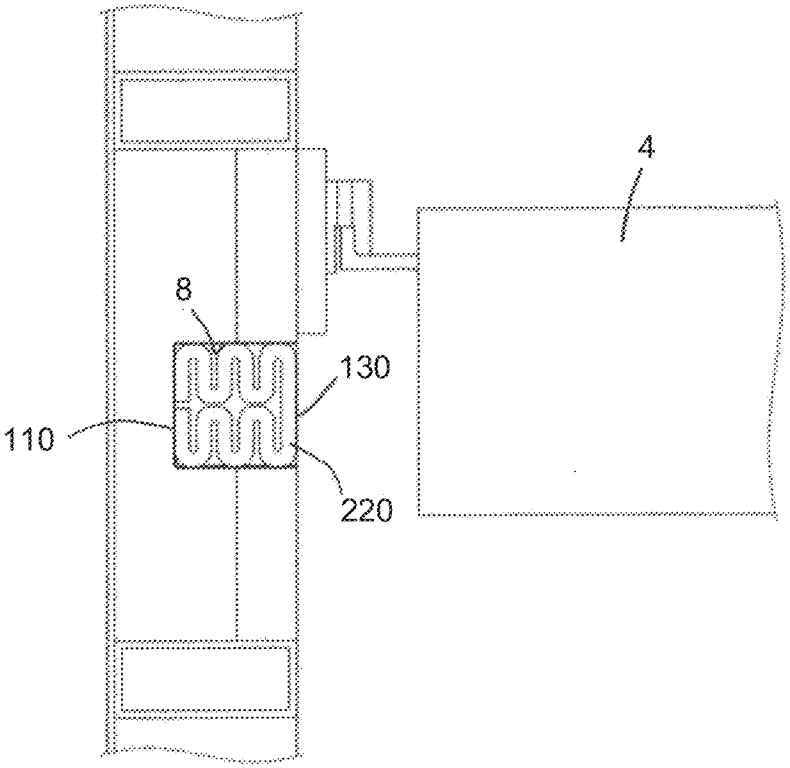

FIGS. 9A and 9B show examples of closed and open states of another embodiment of a zero-spandrel design for a united panel construction. Like the other embodiments, this zero-spandrel design may be adapted for installation in a curtain wall assembly of a building.

In FIG. 9A, the zero-spandrel design is shown in a compressed state and includes a different type of insulation material 220 from other embodiments. As shown in FIGS. 5, 8A, and 8B, the insulation material 120 has substantially a solid block configuration. However, in FIG. 9A, insulation material 220 may have a substantially accordion shape when in a compressed state. The insulation material may be made of the same material as insulation material 120 and/or may include one or more different materials.

The accordion shape may take one of a variety of forms. For example, the zero-spandrel design of FIG. 9A may have the same box 110, door 130, and opener 140 as in other embodiments discussed herein. However, the insulation material 220 may include a single elongated piece or length of insulation material that is configured to have one or more bent or U-shaped portions when in a compressed state prior to door 130 being opened.

In FIG. 9B, the insulation material 220 is shown in an uncompressed state. When the opener 140 opens the door 130, the insulation material 220 extends in a direction towards the floor 4 to occupy all or a substantial portion of the safing slot 5. In this position, the insulation material 220 is able to block smoke, fire and noise.

To accomplish the transition to the uncompressed state, in one embodiment the insulation material (e.g., foam) 220 may be flexible, but at the same time have sufficient rigidity or density to allow the foam to effectively spring out of the cavity 8 of the box towards the floor 4. The foam may achieve this springing action as a result of being compressed prior to opening the door 130.

In one embodiment, the springing action may be assisted by including a spring incorporated on or in the insulation material 220. The spring may increase the extension force of the insulation material 220 when transitioning from the compressed state to the uncompressed state. However, whether assisted or unassisted by a spring, the insulation material 220 may assume a predetermined shape in the uncompressed state. In FIG. 9A, the predetermined shape is substantially a hollow rectangle but may be a different shape in another embodiment.

Also, in one embodiment, two or more strips, lengths, sections, or pieces of insulation material may be provided in the interior space of the box and that spring forward to a predetermined shape and/or in a predetermined direction to occupy the safing slot 5 in the uncompressed state.

It has been shown that the unitized panel makes it easier for the installers to build up the curtain wall on the jobsite. A unitized curtain wall panel production allows the curtain wall manufacturers to install all required curtain wall components offsite and then ship the complete unitized panel onsite for an easy quick installation on to the building.

As such, the unitized panel installed within an exterior dynamic curtain wall assembly of the present invention provides a system for effectively maintaining a complete seal in a safing slot when utilizing a glass curtain wall construction, vision glass extends to the finished floor level below.

The curtain wall design of the present invention clearly simplifies fire protection installation and can be used to add additional insulation for other mechanical purposes, such as for example STC, R-value, and the like.

Finally, it has been shown that the unitized panel installed within an exterior dynamic curtain wall assembly according to the present invention is also for acoustically insulating and sealing of a safing slot of a curtain wall structure.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A method of installing a box assembly into a curtain wall construction, the method comprising:

positioning the box assembly, and applying a force to rip a hole in a door of the box assembly, thereby allowing a foam in an interior space of the box assembly to at least partially extend into a safing slot or building joint of the curtain wall construction, wherein the box assembly in an uninstalled state comprises:

a box;

the door, enclosing the interior space of the box assembly;

an opener configured to open the door; and an insulation material in the interior space of the box, wherein the insulation material is in a compressed state in the interior space when the door is closed, and wherein the insulation material is configured to transition to an uncompressed state when the opener opens the door, the insulation material configured to at least partially extend from the interior space into a safing slot adjacent the curtain wall when the box is in an installed state and the door is opened, wherein the opener includes a string coupled to the door, wherein the string is configured to apply a force to rip a hole in the door, to allow the insulation material to at least partially extend from the interior space and transition to the uncompressed state, and wherein the insulation material comprises the foam, which is in a compressed state in the interior space when the door is closed.

2. A curtain wall construction, comprising:

a safing slot or building joint, and an insulation material obtained by the method of claim 1.

3. The method of claim 1, wherein the insulation material is in a block configuration when compressed in the interior space of the box.

4. The method of claim 1, wherein the insulation material is in an accordion configuration when in the compressed state in the interior space.

5. The method of claim 4, wherein the insulation material corresponds to a single length of material disposed in the accordion configuration.

6. The method of claim 4, wherein the insulation material includes at least two sections of material disposed in the accordion configuration.

7. The method of claim 1, wherein the insulation material has a predetermined shape when at least partially extending from the interior space and transitioning to the uncompressed state.

8. The method of claim 1, wherein the opener is configured to open the door about a rotational pivot point to allow the insulation material to at least partially extend from the interior of the box and transition to the uncompressed state.

9. The method of claim 1, wherein the insulation material includes a fire-resistant material.

10. The method of claim 9, wherein the fire-resistant material is an intumescent material.

11. The method of claim 1, wherein the box is a five-sided metal box pan.

12. The method of claim 1, wherein the box includes at least one flange configured for coupling to a frame of the curtain wall.

13. The method of claim 1, wherein the door comprises aluminum or plastic.

14. The method of claim 1, wherein the door comprises perforations, configured to facilitate ripping open the door with the string.

15. The method of claim 1, wherein the string comprises twine, thread, plastic, cotton, synthetic fiber, or any combination thereof.

16. The curtain wall construction of claim 2, wherein the insulation material is in a block configuration when compressed in the interior space of the box.

17. The curtain wall construction of claim 2, wherein the insulation material includes a tire-resistant material.

18. The curtain wall construction of claim 17, wherein the fire-resistant material is an intumescent material.

19. The curtain wall construction of claim 2, wherein the box includes at least one flange configured for coupling to a frame of the curtain wall.

20. The curtain wall construction of claim 2, wherein the door comprises aluminum or plastic.

* * * * *